US007731385B2

(12) United States Patent
Spartano et al.

(10) Patent No.: US 7,731,385 B2
(45) Date of Patent: Jun. 8, 2010

(54) MULTI-MODE FLASHLIGHT

(75) Inventors: David A. Spartano, Brunswick, OH (US); John D. Crawford, Avon, OH (US); Joseph P. Gardner, North Ridgeville, OH (US); Michael W. Sanders, O'Fallon, MO (US); Scott W. Osiecki, Skaneateles, NY (US); Ronald J. Kingston, Syracuse, NY (US); Mark A. Ferguson, Memphis, NY (US); Kang Woon Au, Kowloon (HK); Wai Kwong Lam, Metro (HK); Thomas I. Meyers, Cayuga, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 49 days.

(21) Appl. No.: 11/637,258

(22) Filed: Dec. 11, 2006

(65) Prior Publication Data

US 2007/0145912 A1 Jun. 28, 2007

Related U.S. Application Data

(63) Continuation-in-part of application No. 29/240,722, filed on Oct. 18, 2005, now Pat. No. Des. 536,464.

(51) Int. Cl.

| | |
|---|---|
| ***F21L 4/00*** | (2006.01) |
| ***F21L 4/04*** | (2006.01) |
| ***F21S 4/00*** | (2006.01) |
| ***F21V 33/00*** | (2006.01) |

(52) U.S. Cl. ..... 362/197; 362/184; 362/205; 362/206; 362/249.05; 362/249.13

(58) Field of Classification Search ..... 362/184, 362/197, 205, 206, 212, 249.05, 249.12, 362/249.13

See application file for complete search history.

(56) References Cited

U.S. PATENT DOCUMENTS

| | | | | |
|---|---|---|---|---|
| 4,274,130 | A * | 6/1981 | Elliott | 362/184 |
| 4,831,504 | A * | 5/1989 | Nishizawa et al. | 362/100 |
| 5,097,399 | A * | 3/1992 | Gammache | 362/197 |
| 5,821,697 | A | 10/1998 | Weber | |
| 5,871,272 | A * | 2/1999 | Sharrah et al. | 362/184 |

(Continued)

FOREIGN PATENT DOCUMENTS

WO 0177575 A 10/2001

OTHER PUBLICATIONS

James & Wells Intellectual Property, Response to IPONZ Examination Report of Jul. 17, 2008 for New Zealand Patent Application No. 569709, mailed Feb. 19, 2009, 8 pgs., Tauranga, NZ.

(Continued)

*Primary Examiner*—Jacob Y Choi
*Assistant Examiner*—David J Makiya
(74) *Attorney, Agent, or Firm*—Gregory J. Adams

(57) ABSTRACT

A lighting device includes one or more light sources, one or more switches, and a controller. The lighting device has multiple modes of operation. The controller selects modes of operation according to the one or more switches. The controller controls or operates the one or more light sources according to the selected mode of operation.

11 Claims, 12 Drawing Sheets

U.S. PATENT DOCUMENTS

| | | | | |
|---|---|---|---|---|
| 5,909,062 | A * | 6/1999 | Krietzman | 307/64 |
| 5,944,407 | A * | 8/1999 | Lynch et al. | 362/198 |
| 6,095,661 | A | 8/2000 | Lebens et al. | |
| 6,158,874 | A * | 12/2000 | Brustein et al. | 362/184 |
| 6,272,004 | B1 * | 8/2001 | McDermott | 361/600 |
| 6,722,771 | B1 * | 4/2004 | Stephens | 362/184 |
| 6,913,371 | B2 * | 7/2005 | Ping | 362/199 |
| 6,953,260 | B1 * | 10/2005 | Allen | 362/194 |
| 7,023,004 | B2 | 4/2006 | Ford et al. | |
| 7,334,915 | B2 * | 2/2008 | Kim | 362/205 |
| 2002/0097576 | A1 * | 7/2002 | Sharrah et al. | 362/194 |
| 2004/0140771 | A1 * | 7/2004 | Kim et al. | 315/86 |
| 2005/0078476 | A1 * | 4/2005 | Ping | 362/199 |
| 2005/0122712 | A1 | 6/2005 | Kim | |

OTHER PUBLICATIONS

Intellectual Property Office of New Zealand, Examination Report Response to James & Wells Response of Feb. 19, 2009 for New Zealand Patent Application No. 569709, mailed Mar. 13, 2009, 2 pgs., Wellington, NZ.

* cited by examiner

MULTI-MODE FLASHLIGHT

RELATED APPLICATIONS

This application is a continuation in part of U.S. Design Application, 29/240722, Filed Oct. 18, 2005 now U.S. Pat. No. D,536,464, which is hereby incorporated by reference in its entirety.

FIELD OF THE INVENTION

The present invention relates generally to lighting devices and, more particularly, to lighting devices and methods that provide multiple modes of operation.

BACKGROUND OF THE INVENTION

Current flashlights typically have limited functionality and performance. Generally, conventional flashlights include a housing, batteries disposed in the housing, a bulb holder, a bulb, and a switch. The switch, is typically located on the outer circumference of the housing and can be activated to alternatively turn the flashlight on and off. The bulb holder typically includes a spring that is biased against the batteries in the housing as the lamp holder is screwed onto the housing. The spring also serves as an electrical contact for powering a lamp in the lamp holder.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

Embodiments of the invention include lighting devices that include multiple modes of operation and methods of operation. The multiple modes can be employed for varied situations by a controller or circuitry associated with one or more switches.

In accordance with one embodiment of the invention, a lighting device is disclosed. The lighting device includes one or more light sources, one or more switches, and a controller. The lighting device has multiple modes of operation. The controller selects modes of operation according to the one or more switches. The controller controls or operates the one or more light sources according to the selected mode of operation.

In accordance with another embodiment of the invention, a flashlight is disclosed. The flashlight device includes a body, an end cap, a swivel head, and a plurality of switches. The body has an interior defining a battery cavity, a first end and a second end. The end cap is coupled to the first end. The swivel head is coupled to the second end and includes a light housing with a plurality of light sources. A plurality of switches select operation of the plurality of light sources. The plurality of switches include a main light switch positioned on a bottom of the end cap, a rotatable switch disposed between the end cap and the first end, second and third switches located on a front portion of the body. The light sources include an infra-red light emitting diode and a white light emitting diode.

Other devices and methods are disclosed.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

The present invention will now be described with respect to the accompanying drawings in which like numbered elements represent like parts. The figures provided herewith and the accompanying description of the figures are merely provided for illustrative purposes. One of ordinary skill in the art should realize, based on the instant description, other implementations and methods for fabricating the devices and structures illustrated in the figures and in the following description.

Figure 1:
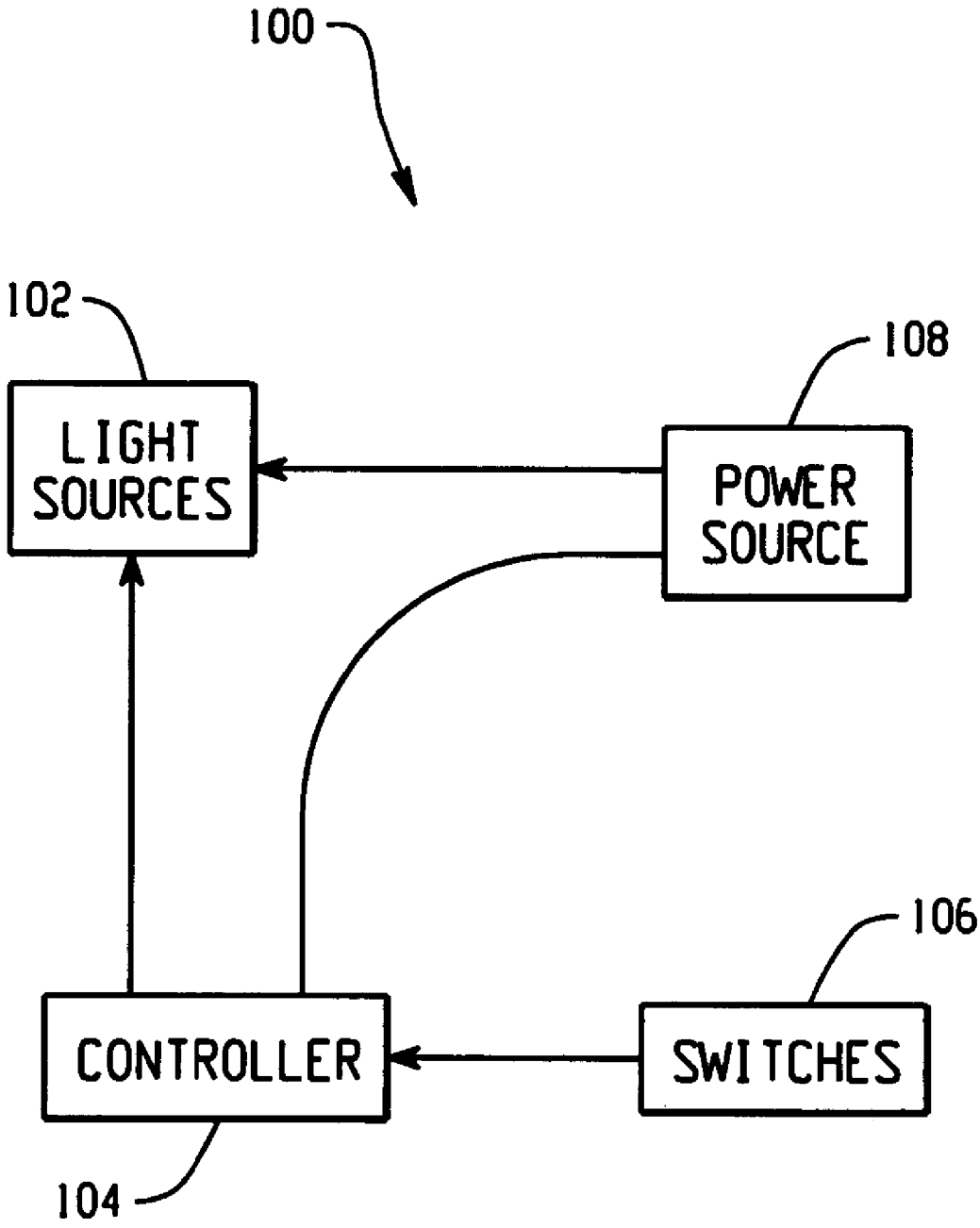
FIG. 1 is a block diagram illustrating a lighting device in accordance with an embodiment of the invention.

FIG. 1 is a block diagram illustrating a lighting device 100 in accordance with an embodiment of the present invention. The lighting device 100 can operate in multiple modes of operation. The lighting device 100 can, for example, be a flashlight, exterior light, automotive light, table lamp, desk lamp, and the like.

The lighting device 100 includes one or more light sources 102, a controller or circuitry 104, one or more switches 106, and a power source 108. The light sources 102 includes suitable lamps or sources, such as, for example, light emitting diodes (LED), incandescent bulbs, fluorescent lights, compact florescent lights, metal halide bulbs, and the like. In one example, the light sources 102 include light sources of varied color temperatures specified in Kelvin, for example, in the ranges of 1,700 to 20,000 Kelvin. In another example, the light sources 102 include light sources of varied wavelengths, such as, for example, a blue light source having a wavelength of about 500-450 nm, a red light source having a wavelength of about 750-610 nm, a white light source having a mixture of wavelengths, an infra red source having a wavelength of less than about 750-1000 nm, and the like. Such an infrared light source can include The controller or circuitry 104 controls operation of the light sources 102. The controller or circuitry 104 comprises a processor and/or circuitry for controlling the light sources 102 according to the switches 106. The controller 104 activate/deactivate or turn on/off one or more of the light sources 102 for one or more modes of operation. Additionally, the controller 104 can alter intensity of one or more of the light sources 102 for the one or more modes of operation. For example, a mode of operation can include activating a red light source of the light sources. In another example, a mode of operation can include activating an infra-red light source and deactivating other light sources. In another example, a mode of operation includes activating multiple light sources of the light sources 102.

The switches 106 allow selection of the one or more modes of operation. The switches 106 can include suitable type switches, such as push button switches, slide switches, and the like. The switches 106 are activated and/or deactivated to select the modes of operation by the controller 104. In one example, a switch is activated to select a mode of operation that activates a red light source. In another example, a switch is activated to select a mode of operation that activates an infra-red light source. In yet another example, one or more of the switches 106 are activated to select a mode of operation that activates or deactivates multiple light sources.

The power source 108 supplies power to the light sources 102. The power supplied by the power source 108 is controlled at least partially by the controller 104. The power source 108 supplies power within a selected voltage and/or current range that permits suitable operation of the light sources 102. The controller 104 can vary intensity of one or more of the light sources 102 by adjusting the power supplied to the light sources 102, for example, by performing pulse width modulation.

The power source 108 can include primary batteries, secondary batteries, batteries of suitable chemistries, such as lithium, alkaline, nickel-metal-hydride, and the like. Also, the power source 108 can include non-battery type power, such as power from a standard AC power outlet, automotive power generator, and the like. Additionally, the power source 108 can comprise power regulation circuits to convert supplied power to the selected voltage and/or current range from non selected direct current and alternating current sources.

It is appreciated that variations of the device 100 are contemplated in accordance with the invention.

FIGS. 2A to 2L are views illustrating a flashlight device 200 in accordance with an embodiment the invention. The device 200 is illustrated and described as an example to further illustrate the invention. It is appreciated that other lighting devices are possible in accordance with the invention.

Figure 2A:
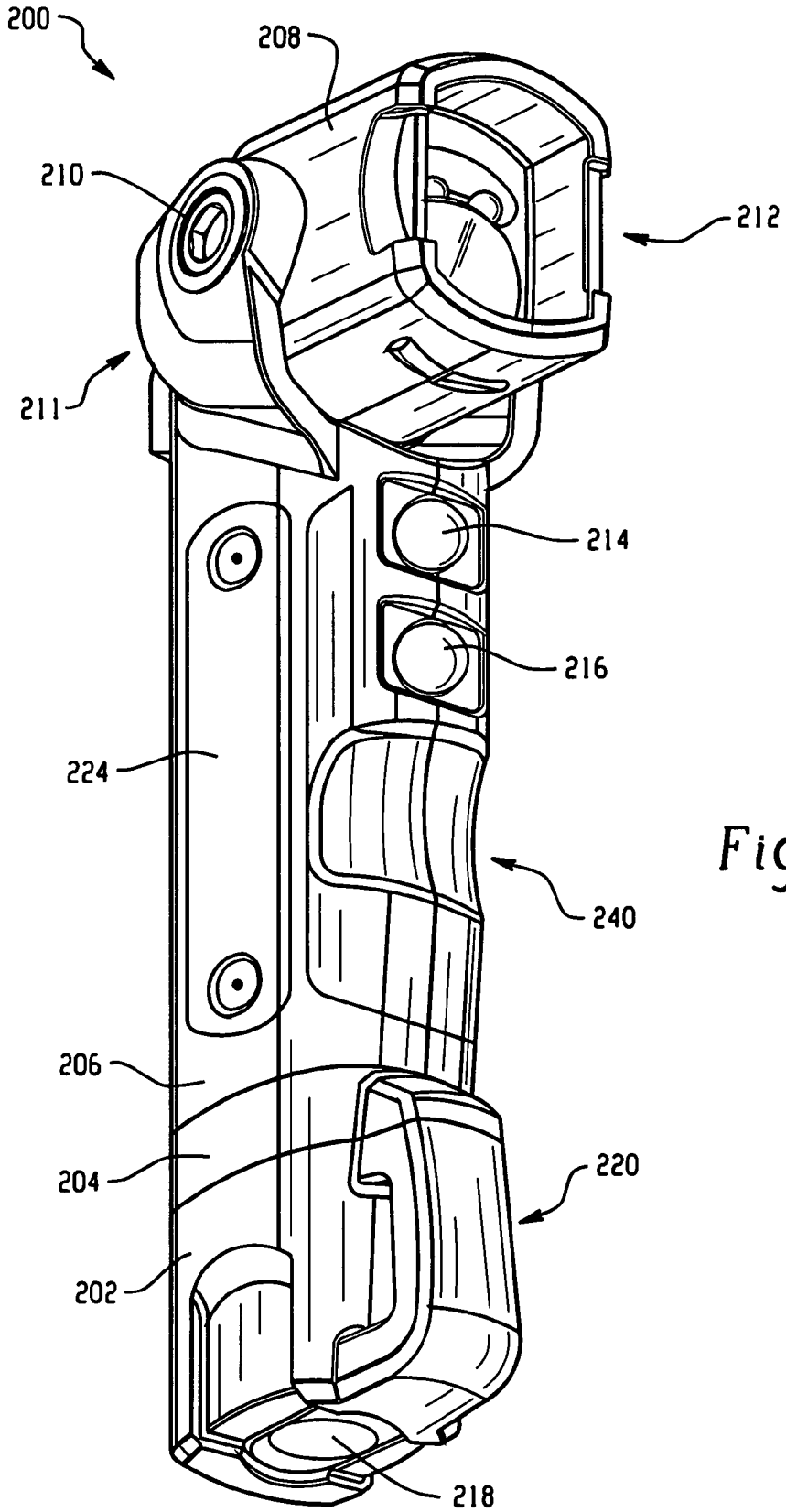
FIGS. 2A to 2L are views illustrating a flashlight device in accordance with an embodiment of the invention.
Figure 2B:
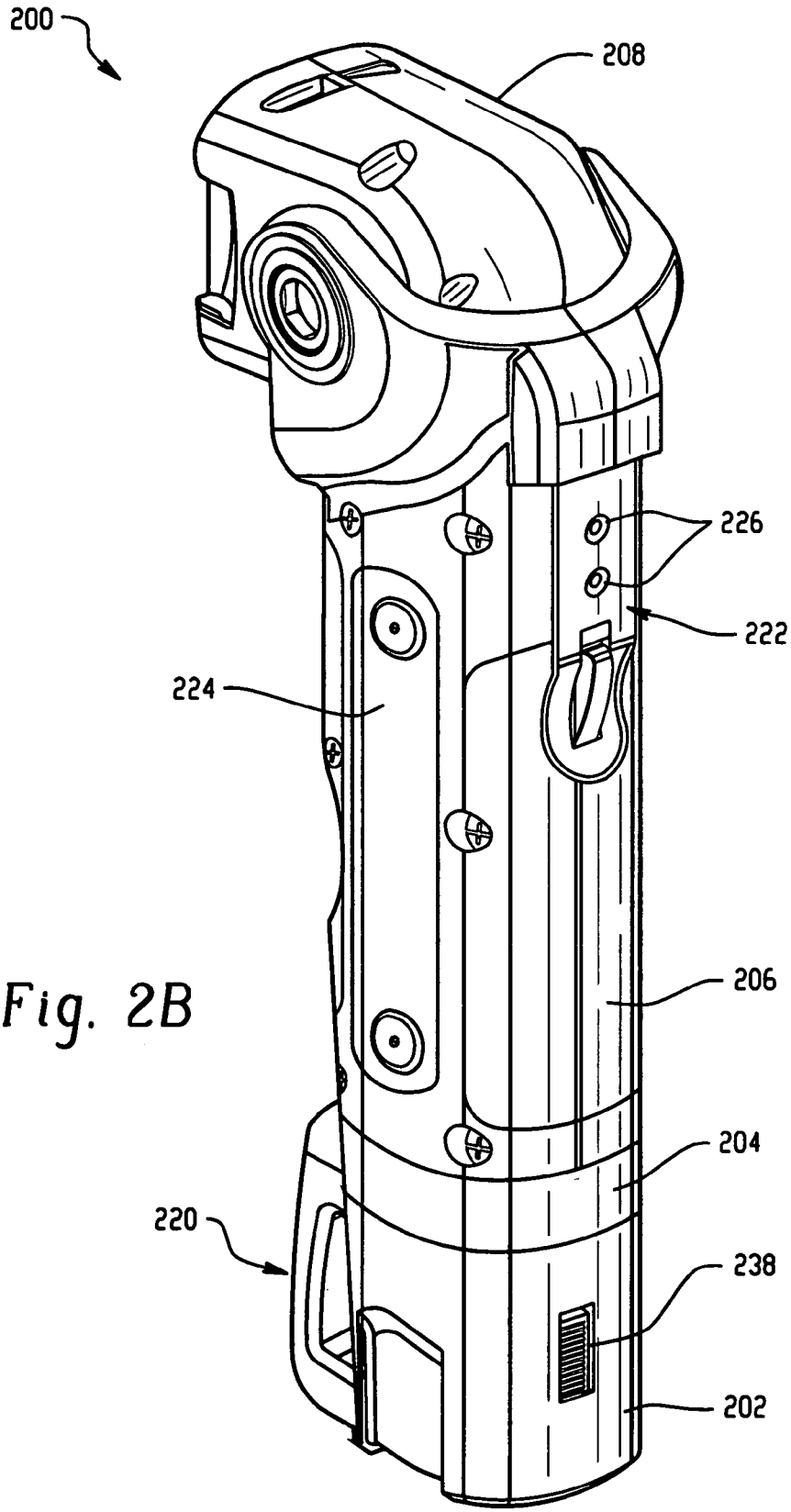

FIG. 2A is a bottom left perspective view of the device 200 and FIG. 2B is a top right perspective view of the back of the device 200 in accordance with an embodiment of the invention.

The device 200 includes an end cap 202 coupled to a body 206. A swivel head 208 is coupled to a yoke portion 211 of the body 206 by a head attachment mechanism 210. An IR switch 204 is disposed between coupling of the end cap 202 and the body 206. Outer surfaces of the end cap 202, the body 206, the IR switch 204, and the swivel head can be at least partially covers with a material that provides a selected amount of grip/traction, noise insulation, electrical insulation, shock resistance, and the like.

The end cap 202 is removably connected to a first end of the body 206. The end cap 202, in this example, includes a first switch 218 for a first mode of operation. The first switch 218 is shown as being recessed by a recess amount so that, for example, accidental dropping of the device 200 does not activate or turn on the first switch. The first switch 218 is positioned on a lower or bottom surface of the end cap 202. It is appreciated that alternate embodiments can omit the first switch and/or locate the first switch at an alternate location on the flashlight device.

An interior of the end cap 202 includes a spring mechanism and one or more contacts. The spring mechanism supports inserted batteries and may also operate as an electrical contact. Additionally, the interior of the end cap 202 can include a threaded portion to facilitate mechanical coupling with the first end of the body 206.

An attachment mechanism 220 is attached to at least a portion of a front side of the end cap 202 and can be considered part of the end cap 202. In one example, the attachment mechanism 220 is a lanyard attachment mechanism that facilitates attachment, for example, by a rope or cord. The attachment mechanism 220 also serves as a foot to facilitate stability of the device 200 when, for example, positioned on a horizontal surface.

A slide switch 238, shown in FIG. 2B, is located on a back side of the end cap 202. The slide switch 238 is position-able to lock or prevent removal of the end cap 202 from the body 206 and also to lock or prevent rotation of the IR switch 204.

The IR switch 204 is rotatable to select or activate an IR mode of operation. Detents and/or other similar mechanisms can be included on the IR switch 204 and/or the first end of the body 206 to indicate selection positions of the IR switch 204.

The body 206 includes the yoke portion 211 at a second end. An interior of the body 206 includes or defines a battery sleeve that includes conductive connections for the first switch 218, the slide switch 238, the IR switch 204, power connections, and the like. Additionally, the battery sleeve supports inserted batteries therein. In one example, the body 206 is comprised of two halves that are mechanically coupled together.

Second and third switches 214, 216 are located on a front portion of the body 206. A grip portion 240 of the body 206 is positioned below the switches 214, 216 and also on the front portion of the body 206 in this example to facilitate handling of the device. In one example, the second and third switches 214, 216 and the grip portion 240 are positioned to allow single handed holding and operation of the switches 214, 216. In this example, the switches 214, 216 are recessed push button switches and can select one or more modes of operation for the device 200. The second and third switches 214, 216 are recessed an amount to mitigate accidental or undesired activation of the switches 214, 216. Additionally, the second and third switches 214, 216 can be color coded corresponding to light sources activated by them.

A clip mechanism 222, shown in FIG. 2B, is located on a back portion of the body 206. The clip mechanism 222 permits attachment of the device 200 to other surfaces and/or structures. In one example, the clip mechanism 222 is employed to attach the device 200 to a shirt pocket or belt. In another example, the clip mechanism 222 is employed to attach the device 200 to a table. The clip mechanism 222 can include additional indentations 226 to mitigate undesired slippage or sliding of the clip mechanism 222 from the other surfaces and/or structures once attached.

The body 206 also includes side plates 224 positioned on opposite sides of the body 206. The side plates 224 are mechanically attached to the sides of the body 206 by a side plate attachment mechanism. The side plates 224 can be removed to allow mechanical attachment of the body 206 to other surfaces or devices. For example, the side plates 225 can be removed and the side plate attachment mechanism employed to attach the body 206 to a radio or other communication device. As another example, the side plate attachment mechanism can be employed to attach the body 206 to a vehicle. As another example, the side plate attachment connects to a helmet or bracket attached to a helmet.

The yoke portion 211 of the body 206 is shaped so as to facilitate connection to the swivel head 208. The yoke portion 211 is located on sides of body 206 and operates in conjunction with the head attachment mechanism 210 to attach the swivel head 208 to the body 206. The head attachment mechanism 210, in one example, includes rods that penetrate into recesses or holes positioned on side portions of the swivel head 208. In one example, the yoke portion 211 and the head attachment mechanism compressively attach to the swivel head 208.

The swivel head 208 includes a light housing 212 and is rotatable via the head attachment mechanism 210. The light housing 212 includes one or more light sources. Power and signaling from the body 206 are received via the head attachment mechanism 210 and/or the yoke portion 211.

Figure 2C:
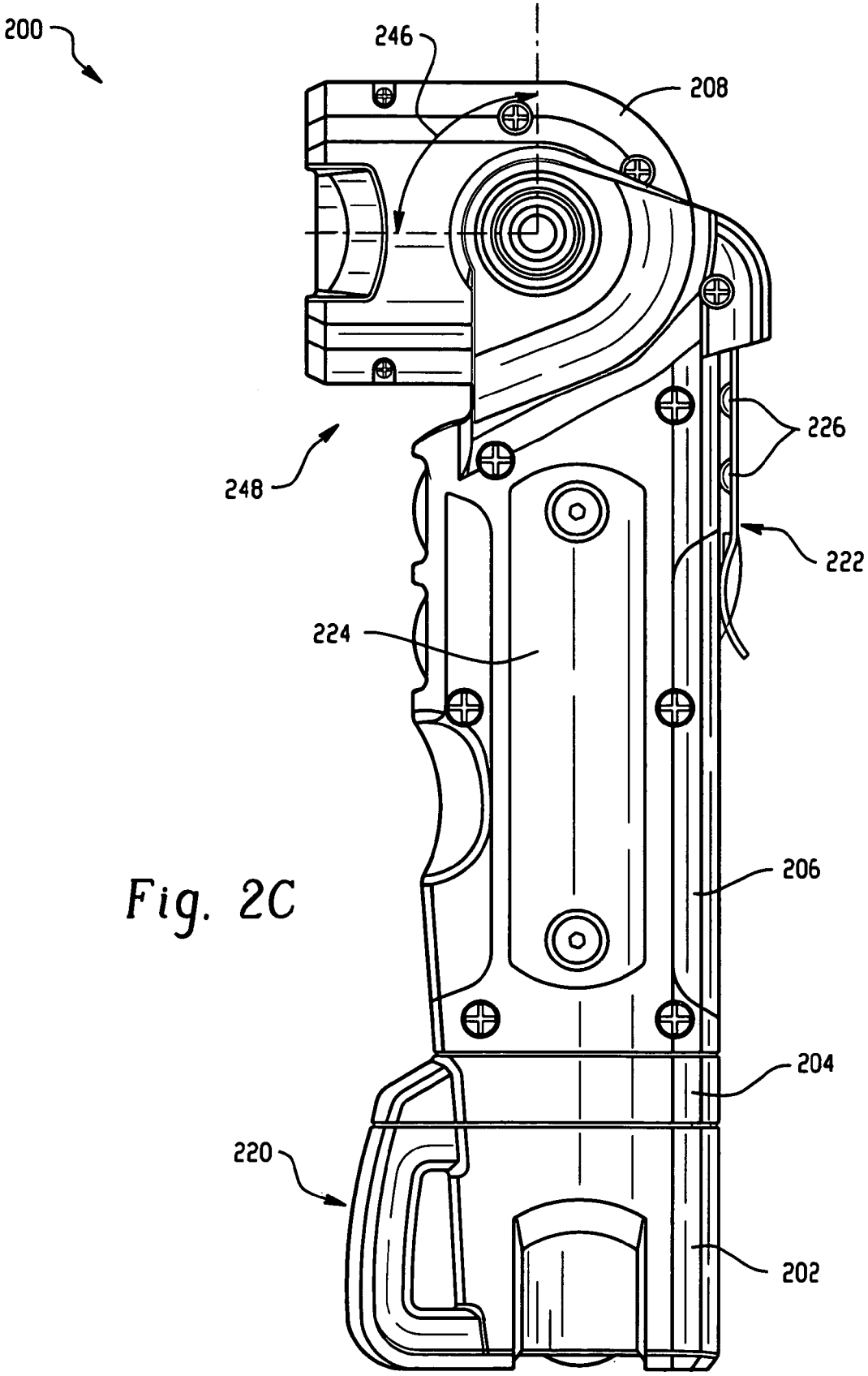
Figure 2D:
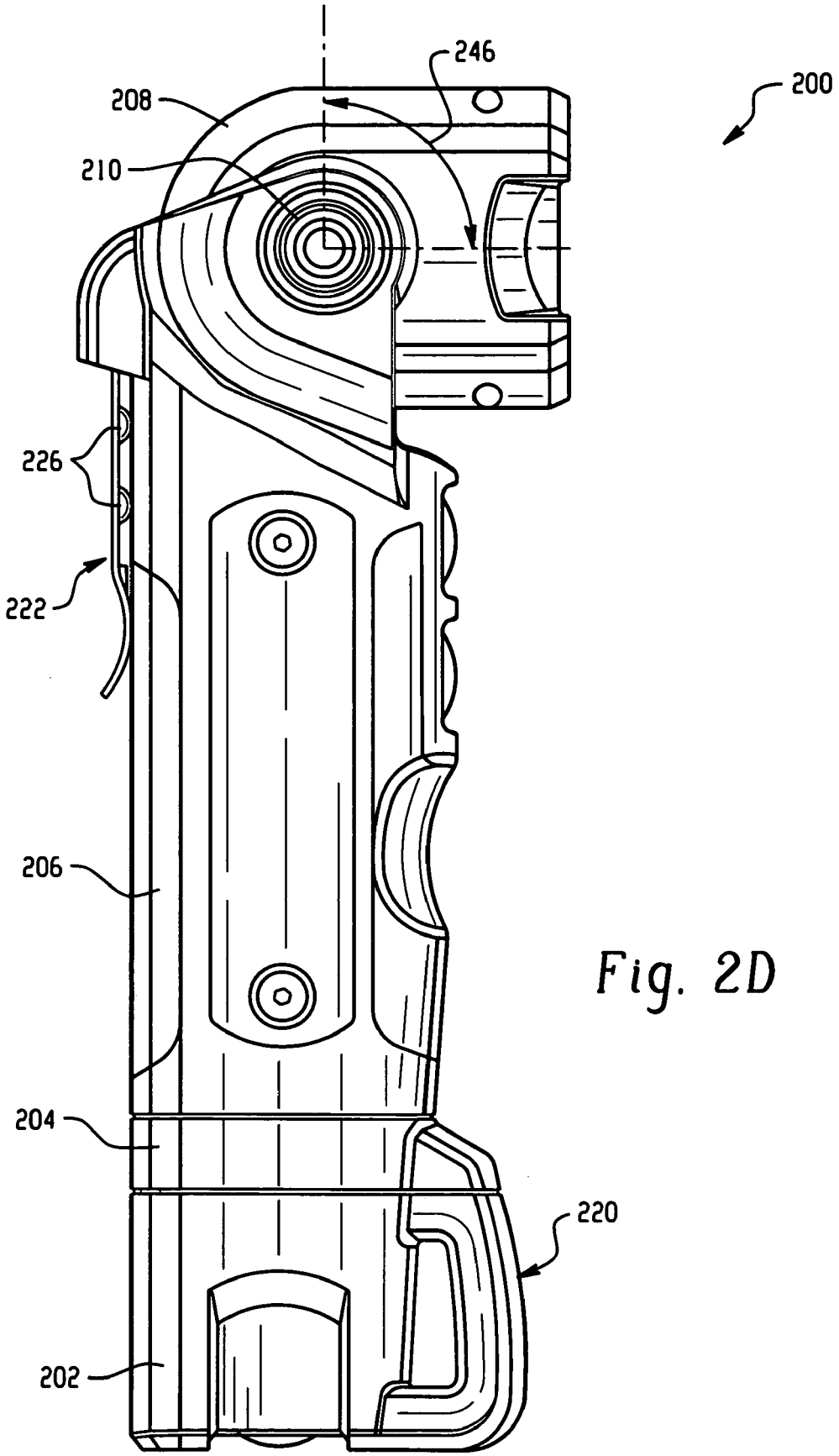

FIGS. 2C and 2D are right and left side views of the device 200 with the swivel head 208 in a first or standard position 248. The first position 248 has an angle of about 90 degrees 246 measured from a vertical axis passing through a center of the head attachment mechanism 210.

Figure 2E:
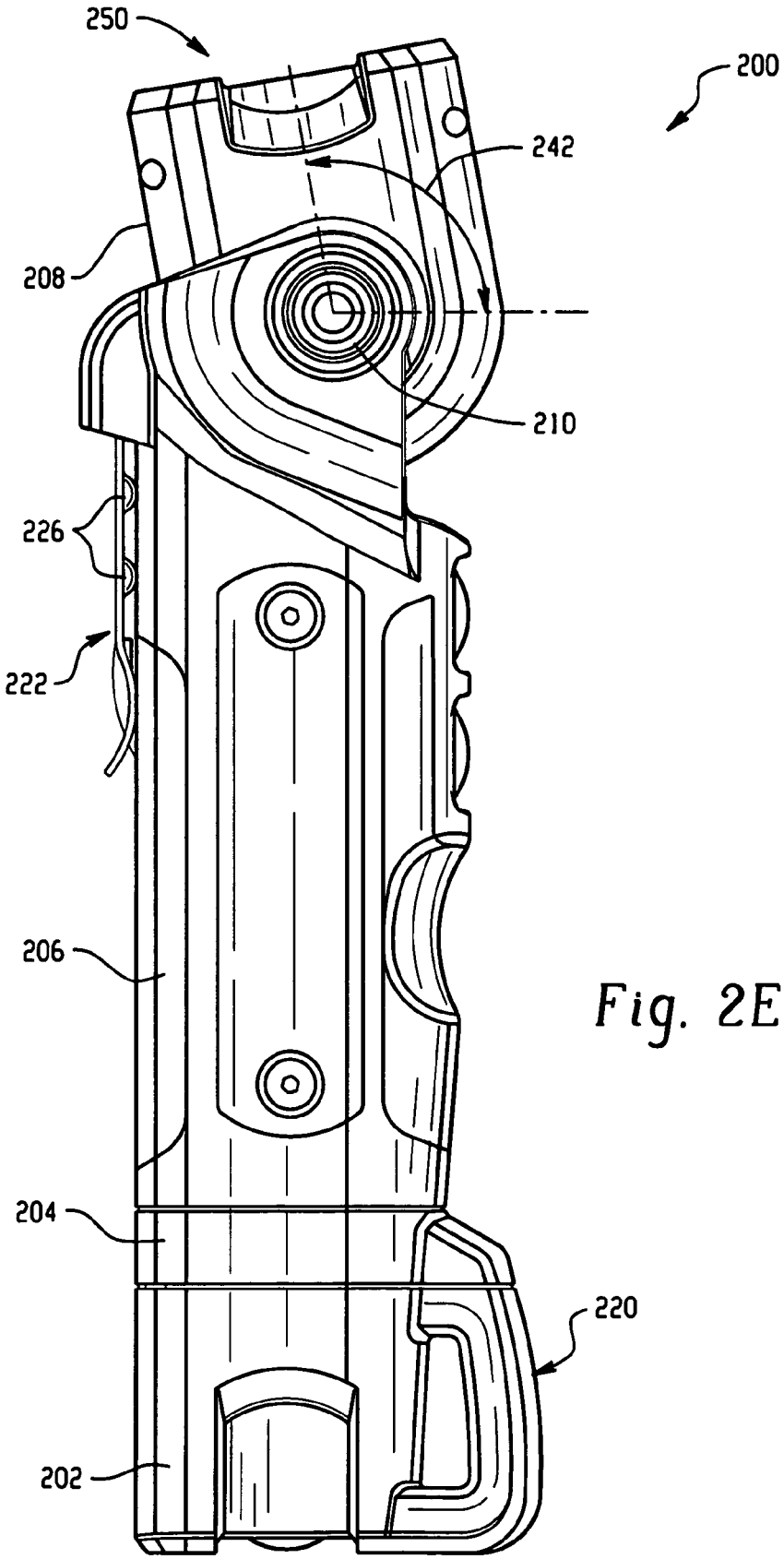

FIG. 2E is a left side view of the device 200 with the swivel head 208 in a second position 250. Here, the swivel head 208 extends an angle 242 greater than 90 degrees from the first position 248. This range of motion or swivel for the head 208 permits, for example, hanging of the device 200 by the attachment mechanism 222 while producing light directed directly below the device 200 and can compensate for listing.

Figure 2F:
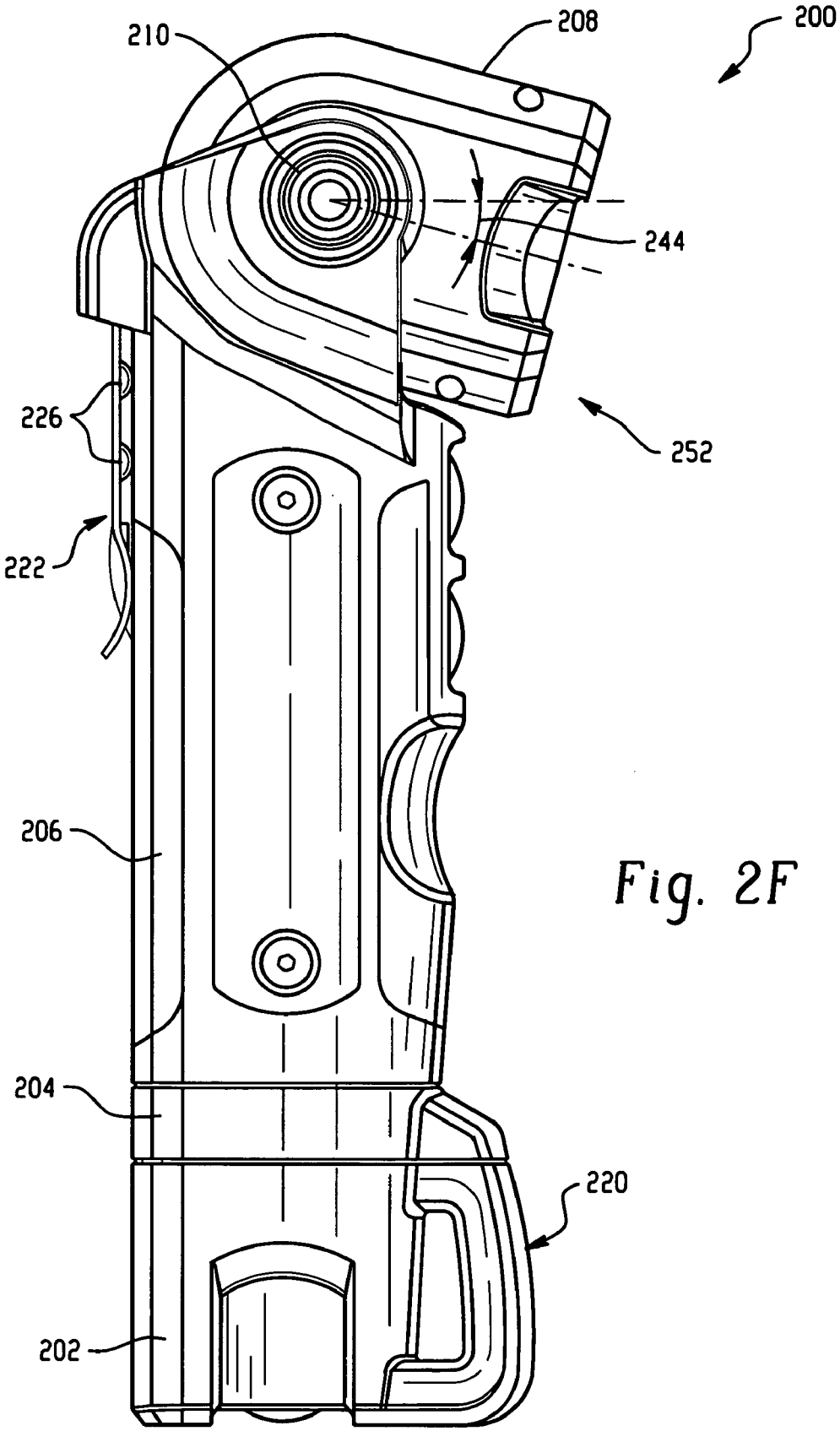

FIG. 2F is another left side view of the device 200 with the swivel head 208 in a third position 252. Here, the swivel head 208 extends in an opposite direction as shown in FIG. 2E and below the first position 248. The swivel head 208 extends an angle 244 to position in the third position 252.

Figure 2G:
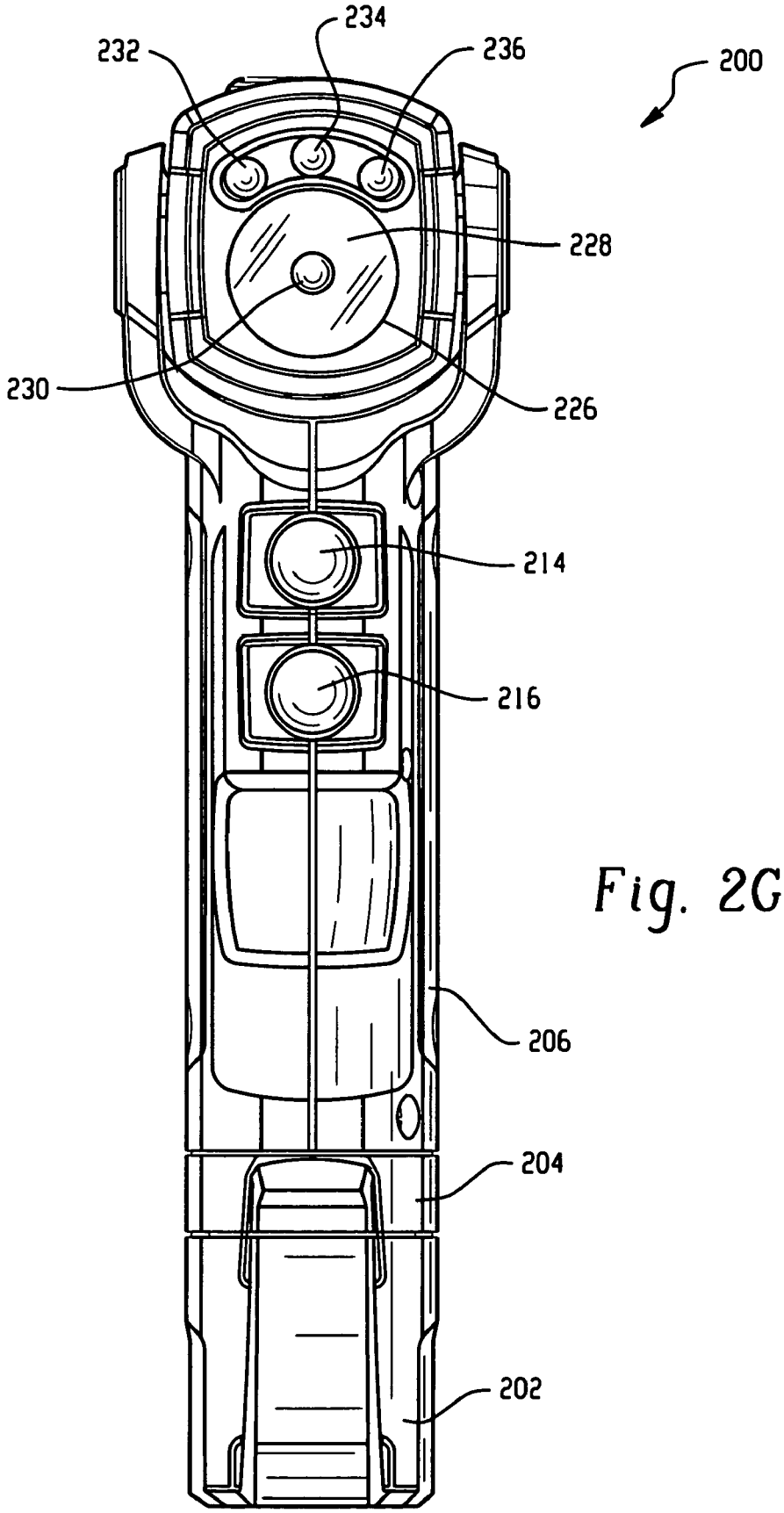

FIG. 2G is a front view of the device 200 that depicts an example configuration of light sources within the light housing 212. The light housing 212 includes a lens 228 and a main reflector 226. The lens 228 can be transparent and/or provide a selected amount of diffusion. The reflector 226 has a suitable shape to facilitate light emission. For example, the reflector 226 can have a parabolic shape, aspheric or non-parabolic shape.

A first light source 230 is positioned about a center of the reflector 226 and generates light. The first light source 230, in one example, is a relatively bright white LED.

A second light source 232 is positioned above and to the left of the first light source 230. The second light source 232 typically has different light emission properties than the first light source 230. For example, the second light source 232 can provide light within the red wavelength range.

A third light source 234 is positioned central and above the first light source. The third light source 234 also typically has different light emission properties than the first light source 230 and/or the second light source 232. In one example, the third light source 234 is an infra red LED and provides light below and within the infra-red range of wavelengths. By being positioned central, the third light source 234 can provide a suitable line of sight, for example, for helicopter pilots.

A fourth light source 236 is positioned above and to the right of the first light source 230. The fourth light source 236 typically, but not necessarily, has different light emission properties than the other light sources 230, 232, 234. In one example, the fourth light source 236 is a blue LED and provides light within the blue range of wavelengths.

The light sources 232, 234, 236 can have individual reflectors distinct from the main reflector 226. Additionally, columns or the like can be positioned about the light sources 232, 234, 236 to facilitate directional lighting.

The arrangement of switches and functions of the device 200 are located in areas to facilitate application of the device. For example, the first switch is recessed and on the bottom. The second and third switches, which can be referred to as signaling lights are at the ready when the light device 200 is gripped, as shown. An infra red activation disables the other light sources.

It is appreciated that alternate embodiments of the invention can include other configurations of light sources and/or differing numbers of light sources and different modes of operation.

Figure 2H:
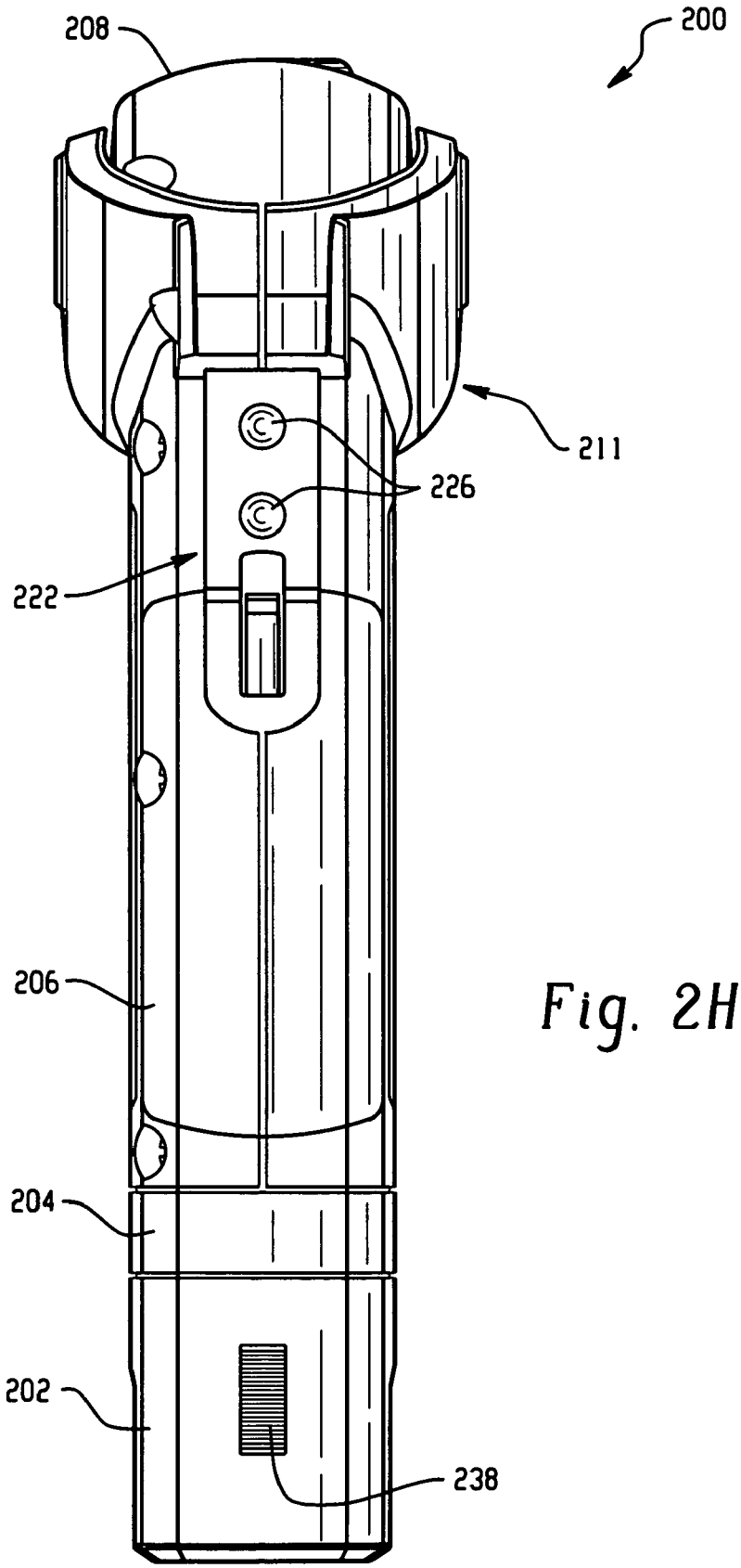
Figure 2I:
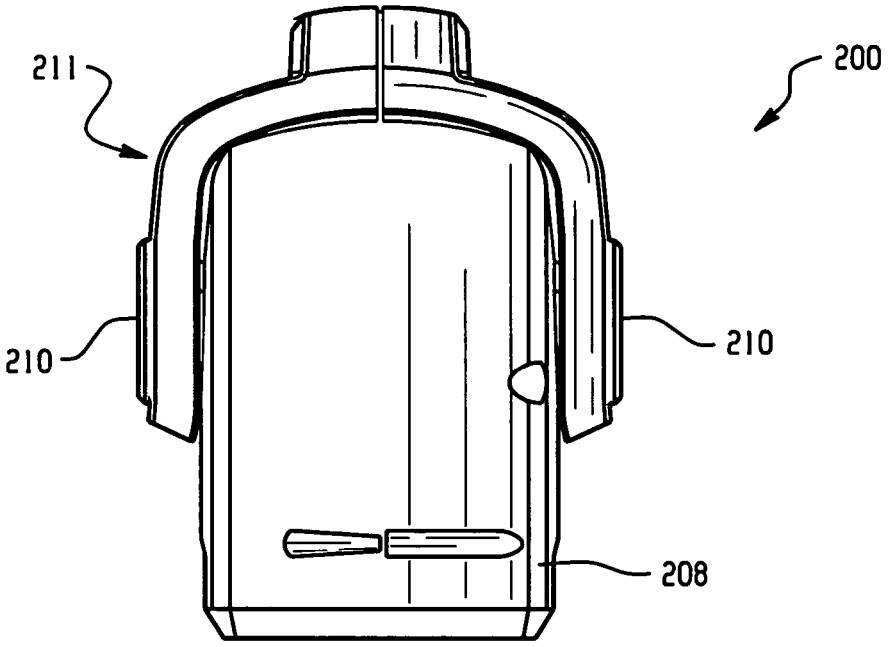
Figure 2J:
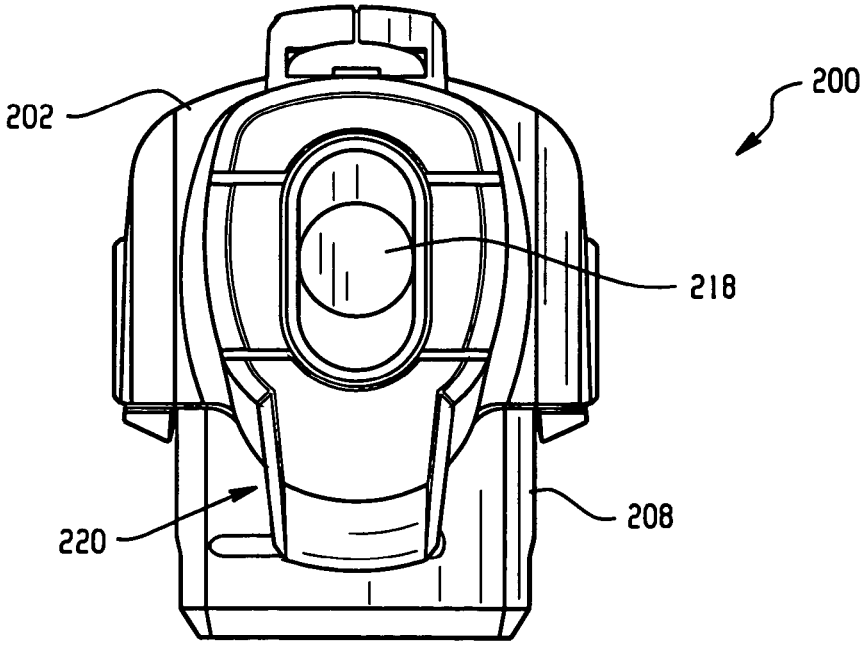

FIG. 2H is a back view of the device 200 showing locations of the slide switch 238 and the attachment clip 222. FIG. 2I is a top view of the device 200 depicting the swivel head 208, the head attachment mechanism 210, and the yoke portion 211. FIG. 2J is a bottom view of the device 200 and illustrates the bottom switch 218 as well as the profile of the end cap 202 and attachment mechanism 220.

Figure 2K:
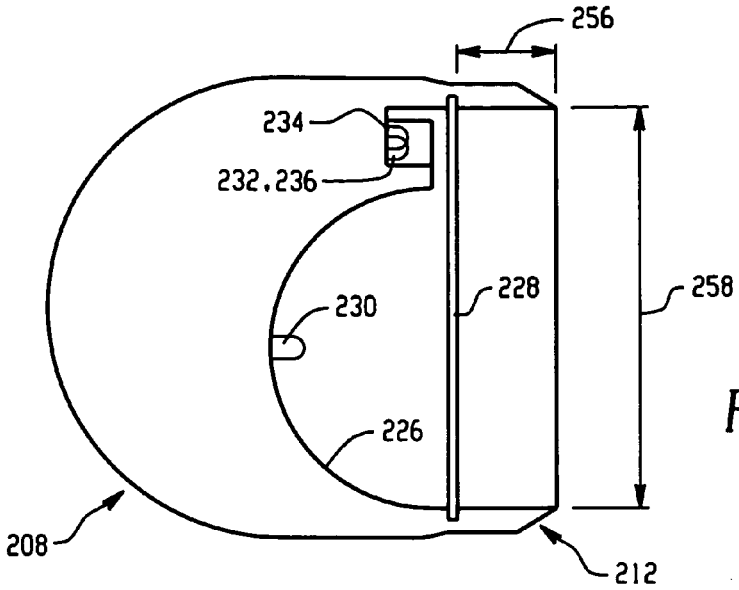

FIG. 2K is a cross sectional view of the swivel head 208 of the device 200. The view illustrates an example of suitable positioning of the lens 228, the reflector 226, the first light source 230, and the other light sources 232, 234, 236. The lens 228 is recessed an amount 256 in order to mitigate divergence of light emitted by the light sources 230, 232, 234, 236 and facilitate directionality. The lens 228 has a vertical dimension 258 selected to allow emission by the light sources 230, 232, 234, 236.

Figure 2L:
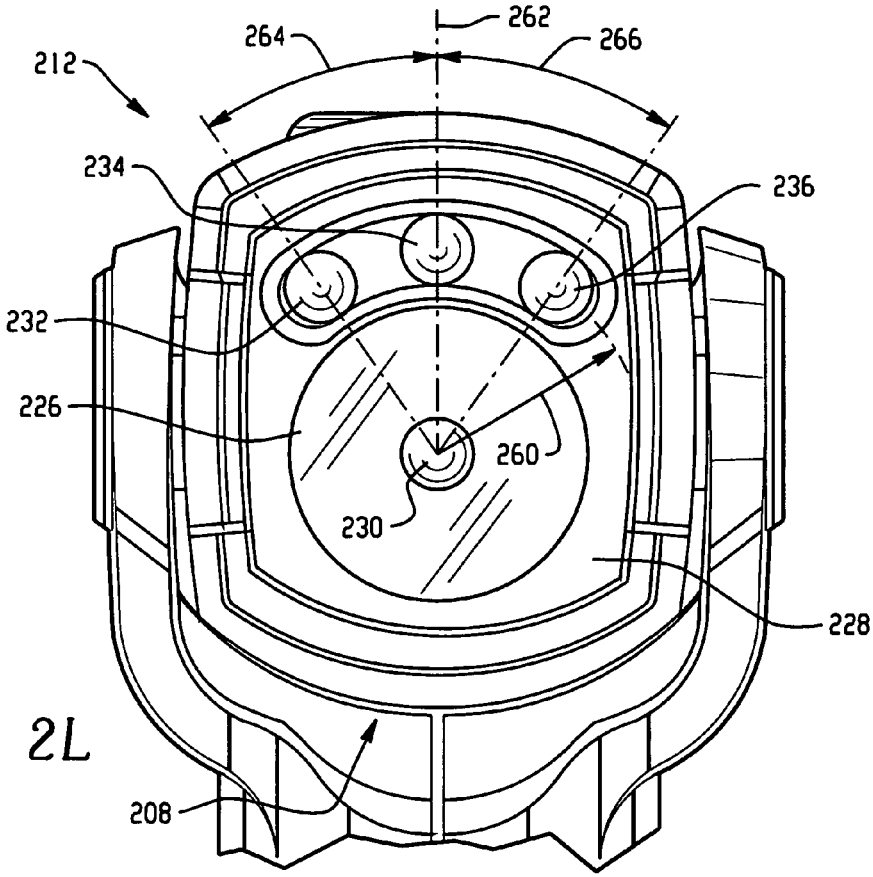

FIG. 2L is a front view of the swivel head 208 that depicts the configuration of the light sources. The first light source 230 and the third light source 234 are positioned along a vertical axis 262. The third light source 234 is positioned a distance 260 above the first light source. The second light source 232 is positioned at an angle 264 to the left of the third light source 234 and the distance 260 from the first light source 230. The fourth light source 236 is positioned at an angle 266 to the right of the third light source and the distance 260 from the first light source 230.

Although not shown, a controller comprising circuitry and/or a processor is located within one or both of the swivel head 208 and the body 206. The controller controllably activates the light sources according to states of the various switches. For example, activation of the IR switch 204 causes the controller to initiate an IR mode of operation wherein only an IR light source of the light sources is activated. Continuing the example, activation of the first switch 218 in the IR mode causes an IR light source to turn on and a second activation of the first switch 218 causes the IR source to blink, and a third activation of the first switch 218 causes the IR source to turn off. As another example, activation of the second switch 214 causes the controller to turn on the second light source 232 and leave other light sources in their current state. Continuing, deactivation of the second switch 214 causes the controller to turn off the second light source 232 and leave other light sources in their current state.

The above figures and description are provided as an example of a flashlight device in accordance with an embodiment of the invention. It is appreciated that alternate embodiments can include variations in switches, shape, light sources, and the like and still be in accordance with the invention.

Figure 3:
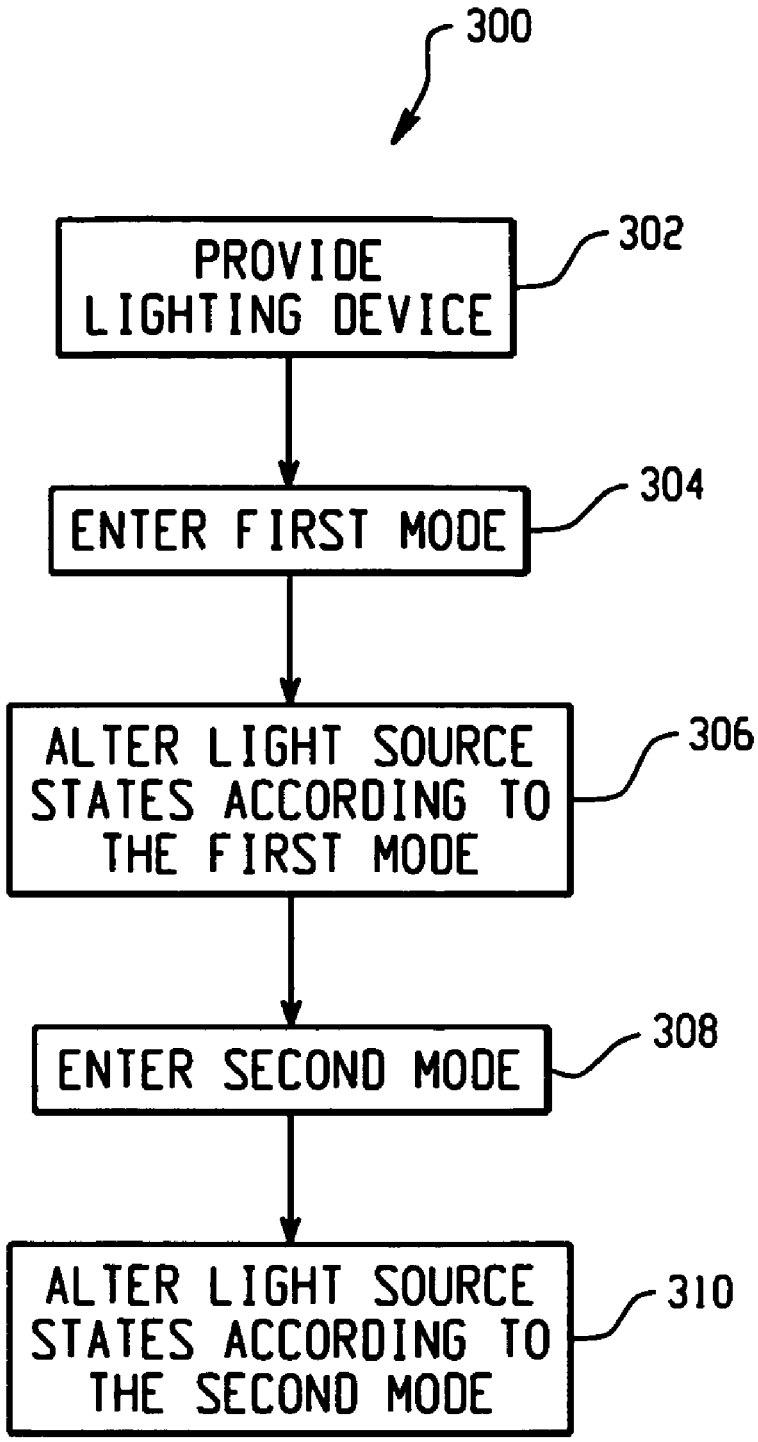
FIG. 3 is a flow diagram illustrating a method of operating a light device in accordance with an embodiment of the invention.

FIG. 3 is a flow diagram illustrating a method 300 of operating a light device in accordance with an embodiment of the invention. The above figures can be referenced for a better appreciation of the method 300 and variations thereof.

The method begins at block 302, wherein a lighting device having one or more switches and one or more light sources is provided. The lighting device can be a flashlight, desk lamp, exterior light, and the like. The lighting device can be a portable light and/or a fixed light. Additionally, the lighting device can be powered by batteries and/or a standard outlet power source (non-battery source).

A first mode of operation is entered on activation or deactivation of one of the switches at block 304. The first mode of operation can include turning one or more of the light sources on or off.

States of one or more of the light sources are altered on entering the first mode of operation at block 306. For example, all of the light sources can be turned on entering the first mode.

A second mode of operation is entered on activation or deactivation of one of the switches at block 308. The second mode of operation can include turning one or more of the light sources on or off, but typically results in a portion of the light sources having altered states from the first mode.

States of one or more of the light sources are again altered on entering the second mode of operation at block 310. For example, all of the light sources can be turned off on entering the second mode. As another example, one of the light sources can be dimmed. As yet another example, all of the light sources are turned off except an infra-red light source which is turned on.

The method 300 can continue with additional modes of operation and varying states.

It is noted that the method 300 can be performed in an order different than shown in FIG. 3. Additionally, it is appreciated that some portions of the method 300 can be omitted and/or other operations additionally performed in alternate embodiments of the invention.

Although the invention has been shown and described with respect to a certain aspect or various aspects, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several aspects of the invention, such feature may be combined with one or more other features of the other aspects as may be desired and advantageous for any given or particular application. Also, the term "exemplary" is intended as an example, not as a best or superior solution. Furthermore, to the extent that the term "includes" is used in either the detailed description or the claims, such term is intended to be inclusive in a manner similar to the term "comprising."

What is claimed is:

1. A flashlight device comprising:

a body having an interior defining a battery cavity, a first end and a second end;

an end cap coupled to the first end;

a swivel head coupled to the second end and having a light housing with a plurality of light sources, wherein the swivel head rotates around an axis perpendicular to an axis defined by the body; and a plurality of switches that select operation of the plurality of light sources, the plurality of switches including a rotatable switch for controlling operation of an infrared light source of the plurality of light sources that is disposed between the end cap and the first end of the body, second and third button switches for operation of different colored light sources of the plurality of light sources that are mounted on a front portion of the body, and a main light switch for controlling operation of a white light emitting diode of the plurality of light sources that is positioned on a bottom of the end cap and where the main light switch does not control operation of other light sources of the plurality of light sources.

2. The device of claim 1, wherein the front portion includes a grip below the second and third button switches.

3. The device of claim 2, wherein the plurality of light sources further include an infra-red light emitting diode and a red light emitting diode.

4. The device of claim 3, the light housing includes a recessed lens and an aspheric reflector.

5. The device of claim 1, wherein at least one of the body, the end cap, the swivel head, and the plurality of switches are at least partially covered with a noise insulation material.

6. the device of claim 1, wherein at least one of the body, the end cap, the swivel head, and the plurality of switches are at least partially covered with at least one of a grip/traction material, an electrical insulation material, and a shock resistance material.

7. The device of claim 1, wherein at least one of the plurality of switches is recessed.

8. The device of claim 7, wherein the recessed switch is a push button switch positioned on the end cap.

9. The device of claim 1 further comprising a slide switch that locks at least one of the end cap and the rotatable switch to prevent removal of the end cap, and a rotatable-switch of the plurality of switches, to prevent rotation of the rotatable switch.

10. The device of claim 1, further comprising a controller and a slide switch positioned on the end cap, wherein the rotatable switch is activated to select a mode of operation that prevents the controller from selecting another mode of operation and wherein the slide switch is positionable to prevent movement of the rotatable switch and removal of the end cap.

11. The device of claim 1 further comprising a yoke portion configured to connect the swivel head to the body, wherein signaling from the body are received by the swivel head through the yoke portion.

* * * * *